US009957791B2

(12) United States Patent
Neuhaus

(10) Patent No.: US 9,957,791 B2
(45) Date of Patent: May 1, 2018

(54) DETERMINING STIMULATED RESERVOIR VOLUME FROM PASSIVE SEISMIC MONITORING

(71) Applicant: MICROSEISMIC, INC., Houston, TX (US)

(72) Inventor: Carl W. Neuhaus, Houston, TX (US)

(73) Assignee: MICROSEISMIC, INC., Houston, TX (US)

( * ) Notice: Subject to any disclaimer, the term of this patent is extended or adjusted under 35 U.S.C. 154(b) by 308 days.

(21) Appl. No.: 14/784,035

(22) PCT Filed: Apr. 28, 2014

(86) PCT No.: PCT/US2014/035600
§ 371 (c)(1),
(2) Date: Oct. 13, 2015

(87) PCT Pub. No.: WO2014/182479
PCT Pub. Date: Nov. 13, 2014

(65) Prior Publication Data

US 2016/0053606 A1 Feb. 25, 2016

Related U.S. Application Data

(60) Provisional application No. 61/820,748, filed on May 8, 2013.

(51) Int. Cl.
*E21B 47/00* (2012.01)
*E21B 43/267* (2006.01)
*E21B 43/26* (2006.01)

(52) U.S. Cl.
CPC ..... *E21B 47/0003* (2013.01); *E21B 43/26* (2013.01); *E21B 43/267* (2013.01)

(58) Field of Classification Search
CPC .... E21B 47/0003; E21B 43/26; E21B 43/267; E21B 47/02208; G01V 1/288;
(Continued)

(56) References Cited

U.S. PATENT DOCUMENTS 8,898,044 B2 * 11/2014 Craig ..... E21B 43/26 702/6
8,960,280 B2 * 2/2015 McKenna ..... G01V 1/288 166/250.1
(Continued)

OTHER PUBLICATIONS

International Preliminary Report on Patentability, PCT/US2014/035600, dated Nov. 10, 2015.
(Continued)

*Primary Examiner* — Carib A Oquendo
(74) *Attorney, Agent, or Firm* — Richard A. Fagin; Adenike Adebiyi

(57) ABSTRACT

A method for determining a stimulated rock volume includes determining a position of a plurality of seismic events from seismic signals recorded in response to pumping fracturing fluid into a formation penetrated by a wellbore. The signals generated by recording output of a plurality of seismic receivers disposed proximate a volume of the Earth's subsurface to be evaluated. A source mechanism of each seismic event is determined and is used to determine a fracture volume and orientation of a fracture associated with each seismic event. A volume of each fracture, beginning with fractures closest to a wellbore in which the fracturing fluid was pumped is subtracted from a total volume of proppant pumped with the fracture fluid until all proppant volume is associated with fractures. A stimulated rock volume is determined from the total volume of fractures associated with the volume of proppant pumped.

7 Claims, 5 Drawing Sheets

(58) Field of Classification Search
CPC ..... G01V 2210/123; G01V 2210/1234; G01V 3/38; G01V 1/306; G01V 1/30; G01V 1/40
See application file for complete search history.

(56) References Cited

U.S. PATENT DOCUMENTS

| | | | | |
|---|---|---|---|---|
| 9,158,021 | B2 * | 10/2015 | McKenna | G01V 1/42 |
| 9,513,395 | B2 * | 12/2016 | Zhang | G01V 1/288 |
| 9,551,208 | B2 * | 1/2017 | Ma | E21B 43/16 |
| 9,612,359 | B2 * | 4/2017 | Holland | G01V 11/00 |
| 2008/0068928 | A1 | 3/2008 | Duncan et al. | |
| 2010/0256964 | A1 | 10/2010 | Lee et al. | |
| 2011/0110191 | A1 | 5/2011 | Williams-Stroud et al. | |
| 2011/0257944 | A1 | 10/2011 | Du et al. | |
| 2012/0318500 | A1 | 12/2012 | Urbancic et al. | |

OTHER PUBLICATIONS

Lees, J. M., 1998, Multiplet analyses at Coso geothermal: Bulletin of the Seismological Society of America, 88, 1127-1143.
Oda, M. 1985, Permeability Tensor for Discontinuous Rock Masses, Geotechnique vol. 35, p. 483.
Tomic, Abercrombie, and Nascimento, 2009, Geophysics Journal International, vol. 179, pp. 1013-1023.
Steven J. Gibbons and Frode Ringdal, The detection of low magnitude seismic events using array-based waveform correlation, Geophys. J. Int. (2006) 165, 149-166.

* cited by examiner

DETERMINING STIMULATED RESERVOIR VOLUME FROM PASSIVE SEISMIC MONITORING

BACKGROUND

This disclosure relates generally to the field of determining subsurface structures from passive seismic signals. More specifically, the disclosure relates to methods for determining total volume of formation stimulated by networks of rock formation fractures using passive seismic signals. A propped fracture network volume may be used, for example, to estimate expected ultimate recovery from a fractured reservoir.

The performance of a subsurface reservoir is related to, among other factors, the spatial distribution of permeability in the reservoir. Methods are known in the art for estimating permeability distribution for "matrix" permeability, that is, permeability resulting from interconnections between the pore spaces of porous rock formations. Another type of permeability that is present in some reservoirs, and has proven more difficult to simulate the permeability distribution thereof is so called "fracture" permeability. Fracture permeability is associated with breaks or fractures in the rock formation. Fractures may be caused by rock that is stimulated by fractures held open by proppant pumped into the formation through a wellbore with fluid under pressure until the fracture pressure of the formation is exceeded. After pumping, the proppant remains in the fractures and holds them open to create high permeability fluid flow paths from relatively large lateral distances from the wellbore, thus increasing available reservoir drainage volume. Fractures are also known to be present naturally in some rock formations.

Microseismicity induced by reservoir stimulation of the geothermal field has been used to map fracture density. See, Lees, J. M., 1998, *Multiplet analyses at Coso geothermal*: Bulletin of The Seismological Society of America, 88, 1127-1143. In the Lees publication, a downhole monitoring array of several geophones was used to locate and invert source mechanisms, which provide estimates of fracture orientation. Density of the located events was then used to constrain the fracture density in a reservoir model.

Source mechanism inversion is described in, Jost and Herman, 1989, *Seismological Research Letters*, Vol. 60, pp 37-57, and in Aki and Richards, *Quantitative Seismology*, 1980.

Methods for modeling discrete fracture networks are described by Dershowitz, W., and Herda, H., 1992, *Interpretation of fracture spacing and intensity*, in Rock Mechanics, J. R. Tillerson and W. R. Wawersik (eds.), Balkema, Rotterdam, p. 757-766, and La Point P. R., Hermanson J., Thorsten E., Dunleavy M., Whitney J. and Eubanks D. 2001. *3-D reservoir and stochastic fracture network modelling for enhanced oil recovery, Circle Ridge Phospohoria/Tensleep Reservoir, Wind River Reservation, Arapaho and Shoshone Tribes, Wyoming*: Golder Associates Inc., Report DE-FG26-00BC15190, Dec. 7, 2001, 63 p. Several commercial software packages are available that use these methods to generate fracture models. To do reservoir simulation, the fracture networks are used to calculate flow properties given a particular fracture network configuration. One of many methods for calculating fracture permeability is described in Oda, M. 1985, *Permeability Tensor for Discontinuous Rock Masses*, Geotechnique Vol. 35, p 483.

SUMMARY

A method according to one aspect of the disclosure for determining a stimulated rock volume includes determining a position of a plurality of seismic events from seismic signals recorded in response to pumping fracturing fluid into a formation penetrated by a wellbore. The signals are generated by recording output of a plurality of seismic receivers disposed proximate a volume of the Earth's subsurface to be evaluated. A source mechanism of each seismic event is determined and is used to determine a fracture volume and orientation of a fracture associated with each seismic event. A volume of each fracture, beginning with fractures closest to a wellbore in which the fracturing fluid was pumped is subtracted from a total volume of proppant pumped with the fracture fluid until all proppant volume is associated with fractures. A stimulated rock volume is determined from the total volume of fractures associated with the volume of proppant pumped.

Other aspects and advantages of the will be apparent from the following description and the appended claims.

DETAILED DESCRIPTION

Figure 1:
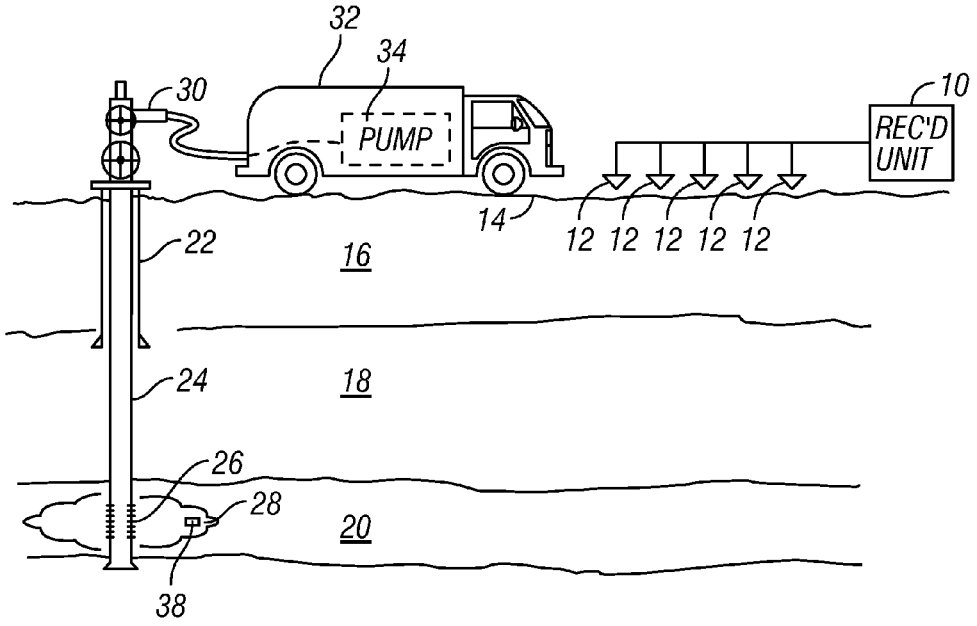
FIG. 1 schematically shows acquiring seismic signals that may be used in a method according to the present disclosure.

FIG. 1 shows a typical arrangement of seismic receivers as they would be used in one application of a method according to the present disclosure. The embodiment illustrated in FIG. 1 is associated with an application for passive seismic emission tomography known as "fracture monitoring." In FIG. 1, each of a plurality of seismic receivers, shown generally at 12, is deployed at a selected position proximate the Earth's surface 14, generally above or proximate to a volume of the subsurface to be evaluated. The seismic receivers 12 can also be deployed in one or more wellbores (not shown) drilled through the subsurface. In marine applications, the seismic receivers would typically be deployed on the water bottom in a device known as an "ocean bottom cable." The seismic receivers 12 in the present embodiment may be geophones, but may also be accelerometers or any other sensing device known in the art that is responsive to velocity, acceleration or motion of the particles of the Earth proximate the sensor. The seismic receivers 12 may also be "multicomponent" receivers, that is, they may each have three sensing elements such as geophones or accelerometers disposed generally along mutually orthogonal directions (or oblique directions but arranged to be able to resolve three orthogonal components), but they can be also single component, typically the vertical component only. The seismic receivers 12 generate electrical or optical signals in response to the particle motion or acceleration, such signals generally being related in amplitude to seismic amplitude, and such signals are ultimately coupled to a recording unit 10 for making a time-indexed recording of the signals from each seismic receiver 12 for later interpretation by a method according to the present disclosure In other implementations, the seismic receivers 12 may be disposed at various positions within one or more monitor wellbores (not shown) drilled through the subsurface formations. A particular advantage of the method of the present embodiment is that it provides generally useful results when the seismic receivers are disposed at or near the Earth's surface. Surface deployment of seismic receivers is relatively cost and time effective as contrasted with subsurface sensor emplacements. It is important that the surface or subsurface (e.g., wellbore) receivers are deployed along multiple azimuths and offsets. This is important for proper performance of the source mechanism inversion (explained below) which would otherwise be unconstrained. Irrespective of the deployment, the seismic receivers 12 are generally deployed proximate an area or volume of the Earth's subsurface to be evaluated. Proximate in the present context may mean within a maximum distance of about 10 km from the position of subsurface occurring seismic events.

In some examples, the seismic receivers 12 may be arranged in sub-groups having spacing therebetween less than about one-half the expected wavelength of seismic energy from the Earth's subsurface that is intended to be detected. Signals from all the receivers in one or more of the sub-groups may be added or summed to reduce the effects of noise in the detected signals.

In the present example, a wellbore 22 is shown drilled through various subsurface Earth formations 16, 18, and through a hydrocarbon producing formation 20. A wellbore tubing or casing 24 having perforations 26 formed therein corresponding to the depth of the hydrocarbon producing formation 20 is connected to a valve set known as a wellhead 30 disposed at the Earth's surface. The wellbore 22 may be used in some examples to withdraw fluids from the formation 20. Such fluid withdrawal may result in microseismic events being generated in the subsurface.

In the present example, the wellhead may be hydraulically connected to a pump 34 in a fracture pumping unit 32. The fracture pumping unit 32 is used in the process of pumping a fluid, which in some instances includes selected size solid particles, collectively called "proppant", are disposed. Pumping such fluid, whether propped or otherwise, is known as hydraulic fracturing. The movement of the fluid is shown schematically at the fluid front 28 in FIG. 1. In hydraulic fracturing techniques known in the art, the fluid is pumped at a pressure which exceeds the fracture pressure of the particular producing formation 20, causing it to rupture, and form fractures therein. The fracture pressure is generally related to the pressure exerted by the weight of all the formations 16, 18 disposed above the hydrocarbon producing formation 20, and such pressure is generally referred to as the "overburden pressure." In propped fracturing operations, the particles of the proppant move into such fissures and remain therein after the fluid pressure is reduced below the fracture pressure of the formation 20. The proppant, by appropriate selection of particle size distribution and shape, forms a high permeability channel in the formation 20 that may extend a great lateral distance away from the tubing 24, and such channel remains permeable after the fluid pressure is relieved. The effect of the proppant filled channel is to increase the effective radius of the wellbore 24 that is in hydraulic communication with the producing formation 20, thus substantially increasing productive capacity of the wellbore 24 to hydrocarbons.

The fracturing of the formation 20 by the fluid pressure is one possible source of seismic energy that is detected by the seismic receivers 12. The time at which the seismic energy is detected by each of the receivers 12 with respect to the time-dependent position in the subsurface of the formation fracture caused at the fluid front 28 is related to the acoustic velocity of each of the formations 16, 18, 20, and the position of each of the seismic receivers 12. Typically the acoustic velocity of the formations 16, 18, 20 will have been previously determined from, for example, an active, controlled source reflection seismic survey or wellbore seismic profile survey using an active, controlled source. The wellbore used for the wellbore seismic profile survey may be the same wellbore used to perform the fracture pumping operations explained above, or a different wellbore.

Having explained passive seismic signals that may be used with methods according to the disclosure, an example method for processing such seismic signals will now be explained. The processing may take place on a programmable computer (not shown separately in FIG. 1) that may form part of the recording unit 10. The processing may take place on any other computer, as will be explained with reference to FIG. 6. The seismic signals recorded from each of the receivers 12 may be processed first by certain procedures well known in the art of seismic data processing, and various forms of filtering. In some embodiments, the receivers 12 may be arranged in directions substantially along a direction of propagation of acoustic energy that may be generated by the pumping unit 32, in the embodiment of FIG. 1 radially outward away from the wellhead 30. By such arrangement of the seismic receivers 12, noise from the pumping unit 32 and similar sources near the wellhead 30 may be attenuated in the seismic signals by frequency-wavenumber (f k) filtering. Other processing techniques for noise reduction and/or signal enhancement will occur to those of ordinary skill in the art.

Figure 2:
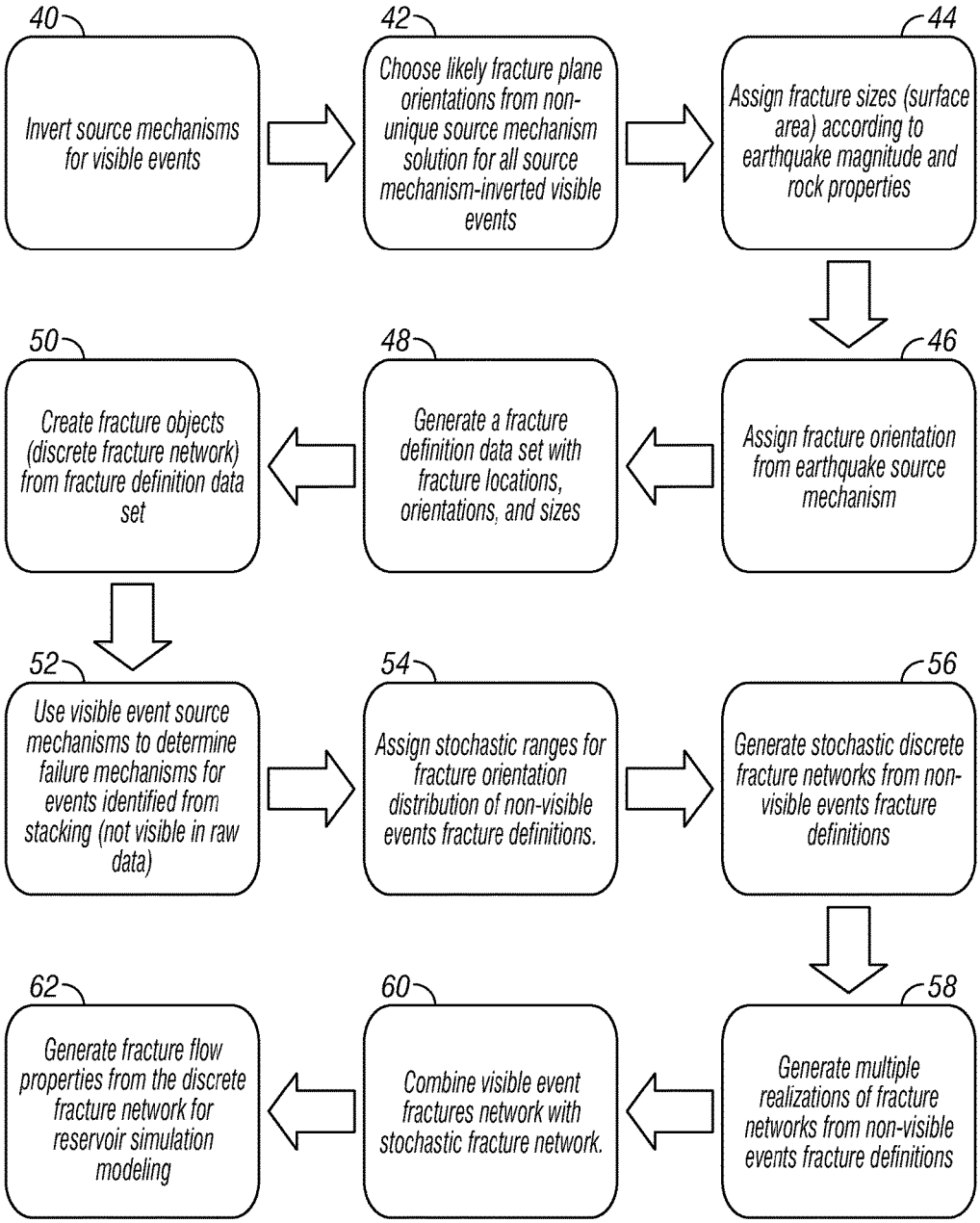
FIG. 2 is a flow chart of an example fracture network modelling method according to the present disclosure.

Referring to FIG. 2, an example process to model a discrete fracture network using the signals recorded as explained above will be explained as to its general procedural elements. More detailed examples of some of the elements of the process will be explained with reference to FIGS. 3, 4 and 5. At 40, "visible" events are identified in the recorded seismic signals. Visible events may be determined, for example, by visual observation of the data recording from each seismic receiver (12 in FIG. 1), and visually selecting amplitudes which have an appearance suggestive of a common seismic event source. "Visible" events may be automatically identified by the computer (FIG. 1 or FIG. 6), for example, by setting a threshold amplitude and having the computer read the data recordings. Any amplitudes above the threshold will be identified as "visible" events. The position of such visible events in the subsurface may be determined using techniques known in the art. Most such techniques use the arrival time of the event on each recording, the position of the respective receivers and the velocity distribution of the formations in the subsurface to identify a most likely origin corresponding to the respective arrival times.

Figure 5:
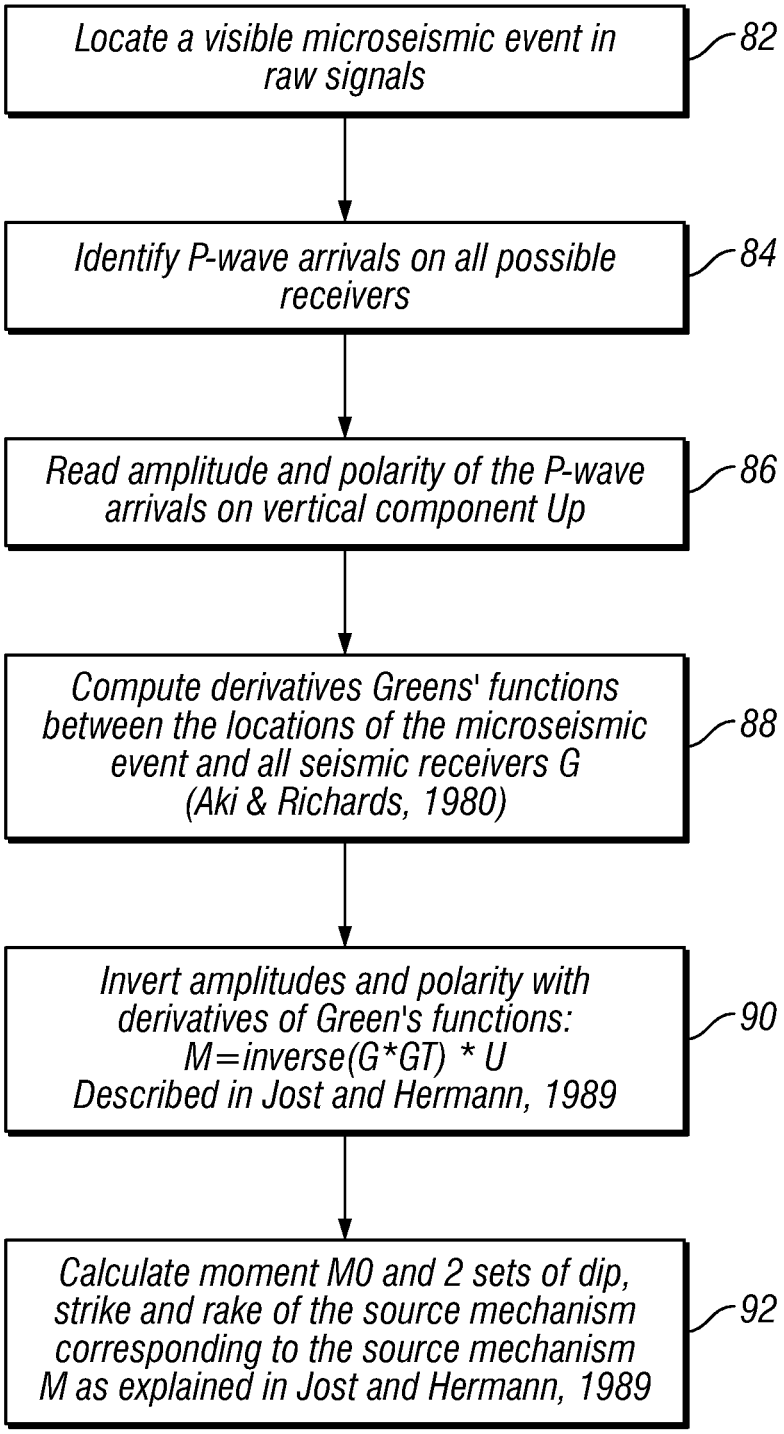
FIG. 5 shows a flow chart of an example technique for source mechanism inversion from microseismic signals.

Each such visible microseismic event may be characterized by its "source mechanism." Identification of the source mechanism in the present context means determining the direction of the volumetric opening, complexity of the fracture plane, fracture plane orientation, the motion of the formations along the fracture plane, and the area subtended by the fracture. Referring to FIG. 5, one method for determining the source mechanism is referred to as "inversion." At 82, the visible events are determined, as explained above. At 84, compressional wave arrivals are determined, also as explained above. At 86, the amplitude of the compressional arrivals' vertical components in the upward direction may be determined. Techniques known in the art for the foregoing include adjusting the amplitude recorded at each seismic receiver for the direction of propagation of the seismic energy from the source location to each seismic receiver. At 88, derivatives of Greens' functions for all seismic event locations and all receiver locations are determined. The foregoing is described, for example, in Aki and Richards, *Quantitative Seismology,* 1980. At 90, the amplitudes and polarities previously determined from the observed seismic signals may be inverted with the Greens' function derivatives. The foregoing is described, for example, in Jost and Herman, 1989, *Seismological Research Letters*, Vol. 60, pp 37-57. At 92, the source mechanism consisting of source moment $M_0$ and the dip, strike and rake of the microseismic events, volumetric change and compensated linear vector dipole are determined, for example, also as described in, Jost and Herman, 1989.

Figure 3:
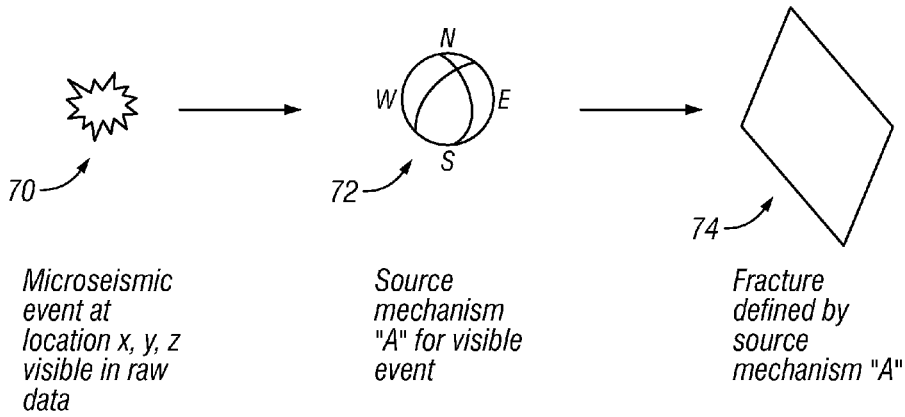
FIG. 3 shows identifying a source mechanism for a "visible" microseismic event.

Referring briefly to FIG. 3, thus for each identified visible event, at 70, located in the subsurface, a source mechanism is identified, at 72. Identification of the source mechanism enables determining, at 74 a fracture plane. Thus, one fracture plane will be identified for each visible seismic event.

Returning to FIG. 2, at 42, likely fracture plane orientations may be chosen from non-unique source mechanism solution for all source mechanism-inverted visible events. At 44, each fracture plane previously identified may have a fracture size determined using an empirical relationship determined from microearthquake measurements. See, for example, Tomic, Abercrombie, and Nascimento, 2009, *Geophysics Journal International*, vol. 179, pp 1013-1023, where seismic moment is related to the seismic event source radius. At 46, the orientation of the fracture may be assigned using the source mechanism determined as explained with reference to FIG. 5. At 48, the foregoing fracture identification, sizing and orientation in a network model may be repeated for all the visible microseismic events. At 50, the visible microseismic event fracture network is then completed.

At 52, the source mechanisms of the visible microseismic events may be used to estimate source mechanisms for microseismic events that are not visible in the recorded receiver signals. Such microseismic events may be determined, for example using a technique described in U.S. Patent Application Publication No. 2008/0068928filed by Duncan et al. Briefly, the method described in the Duncan et al. publication identifies microseismic events by transforming seismic signals into a domain of possible spatial positions of a source of seismic events and determining an origin in spatial position and time of at least one seismic event in the subsurface volume from the space and time distribution of at least one attribute of the transformed seismic data. The determining of the origin includes identifying events in the transformed signals that have characteristics corresponding to seismic events, and determining the origin when selected ones of the events meet predetermined space and time distribution criteria. The method described in the Duncan et al. publication is only one possible method to identify microseismic events that are invisible in the receiver signals. For purposes of defining the scope of the present disclosure, techniques such as the foregoing and others, which enable detection of microseismic events not visible in the recorded signals, may be referred to for convenience as "stacking" techniques because they generally include combination of signals from a plurality of the seismic receivers.

Figure 4:
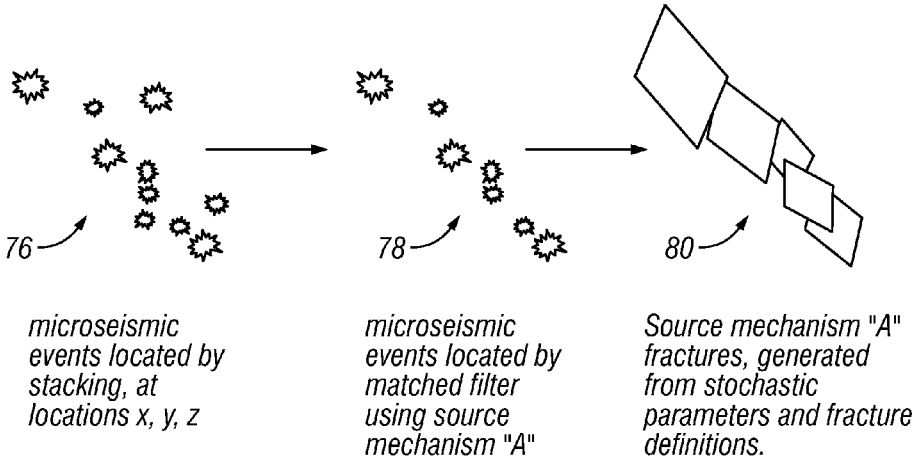
FIG. 4 shows identifying stochastic microseismic events having a common source mechanism.

Referring briefly to FIG. 4, at 76, "invisible" microseismic events are identified using processes such as explained above. Invisible seismic events in the present context means those events not identifiable from amplitude threshold detection or visual observation. At 78, those of the invisible identified microseismic events may be processed by a matching filter to identify those invisible events having a selected source mechanism, for example, the source mechanism identified for each of the visible events. One example of matched filtering is described in, Steven J. Gibbons and Frode Ringdal, *The detection of low magnitude seismic events using array-based waveform correlation*, Geophys. J. Int. (2006) 165, 149-166. Briefly, the matched filtering can be implemented by selecting a correlation time window for each of the seismic signal recordings. Each correlation window may have a selected time interval including an arrival time of the at least one seismic event in each seismic signal. For example, the arrival time may include that of one of the visible events is within the correlation window to assure the source mechanisms are similar. Each correlation window is correlated to the respective seismic signal between a first selected time and a second selected time. Presence of at least one other seismic event in the seismic signals may be determined from a result of the correlating. The microseismic events identified using the matched filter are then used, at 80, to define additional fractures, using essentially the same procedure used to define the fractures for the visible events.

Returning to FIG. 2, at 54, stochastic ranges may be assigned for the fracture orientation distribution of the fractures identified from the invisible events. For example, fracture size distributions may be assigned according to common statistical distributions (e.g. normal, power-law, random). Orientations of the fractures may also be assigned according to statistical distributions as defined by three-dimensional (3D) orientation distributions. At 56, stochastic discrete fracture networks may be generated from the foregoing fracture definitions. At 58, multiple realizations of fracture networks may be generated from the foregoing fracture definitions. Generating multiple fracture networks may be used in some examples because orientations and fracture sizes are assigned stochastically, starting with a random "seed" generated for a particular discrete fracture network ("DFN"). Because the fracture network model is generated as a stochastic process based on a random starting state (the seed value), each time the model generation is performed it is with a different seed; therefore the result will be different. Each DFN will still have the same overall statistical characteristics, but the details of each fracture in each DFN may be different. Calculating multiple realizations (creating multiple results) effectively "smears" or distributes the impact of the randomness on the model. At 60, the visible event fracture network may be combined with the stochastic fracture network. At 62, a geocellular model may be generated from the combined fracture networks to estimate the spatial distribution of fluid flow properties. Geocellular models may be generated using commercially available software tools operable on a programmable computer. Examples of such software include 4DMOVE (a mark of Midland Valley Exploration, Ltd., Glasgow, United Kingdom), GOCAD (a mark of Paradigm Ltd., Georgetown, Cayman Islands), PETREL (a mark of Schlumberger Technology Corporation, Houston, Tex.), EVCELL (a mark Dynamic Graphics, Inc., Alameda, Calif.).

The foregoing example procedure for determining a discrete fracture network is described in U.S. Patent Application Publication No. 2011/0110191 filed by Williams-Stroud et al.

Once the discrete fracture network (DFN) is determined, the following process may be performed to determine the stimulated rock volume (SRV), that is, the volume of the fractures that remain opened by the proppant. Fracture geometry (length, height, width) for every fracture may be determined by microseismic event properties: amplitude or magnitude, taking into account rock properties (shear modulus) and injected fracture fluid volume (including fluid efficiency). The fracture orientation (strike and dip and associated statistical scatter) may be determined based on source mechanisms for the fractures in the DFN, as explained above.

Every fracture may be assumed to be centered on the spatial position of a microseismic event. Such positions may be determined, for example, as explained above with reference to the Duncan et al. publication. For every microseismic event, therefore, a lateral distance from the associated fracture to the wellbore may be determined. Every determined fracture has a determinable volume based on geometry of the fracture determined as explained above.

In the present example, only fractures disposed within a target formation (that is, the one into which the fracture fluid was pumped) may be used in the following process. The depth limits of the formation in which fractures may be used may be adjusted for event uncertainty. Such adjustment may use the following procedure: take the shallowest depth of the known target formation and subtract an average absolute error for calibration shots (e.g., without limitation, explosive detonations or other acoustic source operations conducted in a wellbore at a known depth called "checkshots"). The result of the subtraction represents an upper limit in depth for a subset of the DFN used in the SRV calculation. A similar procedure may be performed for the lowest depth of the target formation. The result reduces the total DFN to a "subset DFN" that will be calculated as being filled with proppant.

The fractures in the subset DFN may be sorted by their respective lateral distances to the wellbore (possible because every fracture is centered on event that has a lateral distance to wellbore associated with it).

A total amount of proppant pumped into the target formation may be obtained, for example, from post job report, invoice, or integration of pump rate measurement curves. Using the identified fractures in the subset DFN sorted by distance to wellbore, begin calculating a void fracture volume that would be filled with proppant. The closest fractures to the wellbore are filled first. The fracture volume may be known from geometry (length, height, width). Proppant density is assumed (e.g., based on a density of loosely packed sand). The volume of the fracture may then be subtracted from the total amount of proppant used. The foregoing proppant volume calculation and subtraction from the total pumped proppant volume may be repeated for successively radially more distant fractures until the remaining proppant volume is zero.

For multiple fracture orientations (due to multiple source mechanisms), in the present example, if the fracture orientation angle between the main fracture orientation (usually in line with maximum horizontal stress) and a secondary fracture orientation is larger than about 45 degrees, one may assign to such fractures only half of the proppant that could theoretically fit into the fracture volume. Using such procedure one may account for tortuosity and the fact that fluid (with proppant in it) has greater resistance to flow around corners.

An equivalent propped fracture length may be defined as the radial distance between the wellbore and the microseismic event that the most distant fracture that contains proppant is centered on.

Figure 6:
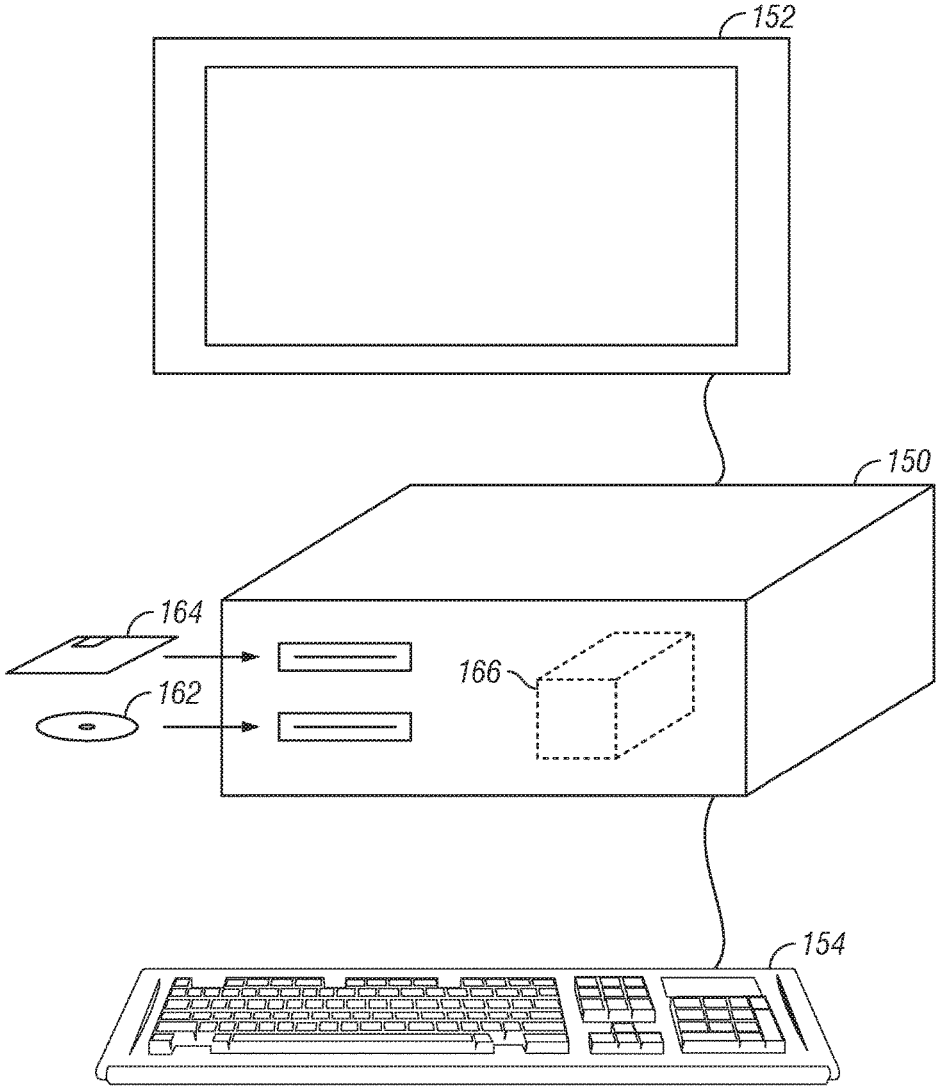
FIG. 6 shows a programmable computer, display and computer readable media.

In another aspect, the disclosure relates to computer programs stored in computer readable media. Referring to FIG. 6, the foregoing process as explained above, can be embodied in computer-readable code. The code can be stored on a computer readable medium, such as a solid state memory 164, CD-ROM 162 or a magnetic (or other type) hard drive 166 forming part of a general purpose programmable computer. The computer, as known in the art, includes a central processing unit 150, a user input device such as a keyboard 154 and a user display 152 such as a flat panel LCD display or cathode ray tube display. The computer may form part of the recording unit (10 in FIG. 1) or may be another computer. According to this aspect, the computer readable medium includes logic operable to cause the computer to execute acts as set forth above and explained with respect to the previous figures. The user display 152 may also be configured to show hypocenter locations and fracture networks determined as explained above.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for determining a stimulated rock volume from microseismic signals, comprising:

determining a position of each of a plurality of seismic events from seismic signals recorded in response to pumping fracturing fluid into a formation penetrated by a wellbore, the signals generated by recording output of a plurality of seismic receivers disposed proximate a volume of the Earth's subsurface to be evaluated, the signals being electrical or optical and representing seismic amplitude;

determining a source mechanism of each of the plurality of seismic events;

determining a fracture volume and orientation of a fracture associated with each of the plurality of seismic events from each source mechanism;

successively subtracting a volume of each fracture, beginning with fractures closest to a wellbore in which the fracturing fluid was pumped from a total volume of a proppant pumped with the fracture fluid and continuing such subtraction for successively radially more distant fractures until the total volume of the proppant is associated with fractures; and determining a stimulated rock volume from the total volume of fractures associated with the volume of proppant pumped.

2. The method of claim 1 further comprising determining a propped fracture length from fractures associated with proppant most distant from the wellbore.

3. The method of claim 1 further comprising constraining positions of the determined fractures by subtracting an uncertainty in vertical position based on uncertainty of a checkshot conducted at a known depth in a wellbore.

4. The method of claim 1 wherein the source mechanism comprises at least one of source moment, dip of the fracture, strike of the fracture, rake of the microseismic events, volumetric change resulting from the fractures and compensated linear vector dipole.

5. The method of claim 1 wherein the determining position of seismic events from the recorded signals comprises determining positions of visible seismic events and determining positions of invisible seismic events having a same source mechanism as the visible seismic events by matched filtering the determined invisible events by a filter corresponding to the visible seismic events.

6. The method of claim 5 wherein the visible seismic events are determined by amplitude threshold detection in the recorded signals.

7. The method of claim 1 further comprising assigning a volume of one half an amount of proppant calculated to otherwise fit within fractures having orientation larger than about 45 degrees from a main fracture orientation to account for tortuosity and greater resistance to proppant containing fluid flow around corners.

* * * * *